US007463749B2

(12) United States Patent
Lee

(10) Patent No.: US 7,463,749 B2
(45) Date of Patent: Dec. 9, 2008

(54) DIAPHRAGM EDGE OF SPEAKER

(75) Inventor: Jong-pyo Lee, Ansan (KR)

(73) Assignees: Jong Pyo Lee, Gyeonggido (KR); Young-Sin Lee, Gyeonggido (KR); Ok-Kyoung Lim, Gyeonggido (KR)

( * ) Notice: Subject to any disclaimer, the term of this patent is extended or adjusted under 35 U.S.C. 154(b) by 509 days.

(21) Appl. No.: 10/781,665

(22) Filed: Feb. 20, 2004

(65) Prior Publication Data

US 2004/0218780 A1 Nov. 4, 2004

(30) Foreign Application Priority Data

Mar. 8, 2003 (KR) ..... 10-2003-0014568

(51) Int. Cl.
*H04R 25/00* (2006.01)

(52) U.S. Cl. ..... 381/398; 381/423; 381/426

(58) Field of Classification Search ..... 381/398, 381/430, 432, 423–428, 169, 170, 171, 172; 181/167, 169, 170, 171, 172; 29/594, 609.1; 84/171; 442/120, 394

See application file for complete search history.

(56) References Cited

U.S. PATENT DOCUMENTS

| | | | | |
|---|---|---|---|---|
| 3,980,841 | A * | 9/1976 | Okamura et al. | 181/294 |
| 6,039,145 | A * | 3/2000 | Ogura et al. | 181/167 |
| 6,680,430 | B2 * | 1/2004 | Tabata et al. | 84/171 |
| 2003/0134553 | A1 * | 7/2003 | Sheffer | 442/120 |

* cited by examiner

*Primary Examiner*—Huyen D Le
(74) *Attorney, Agent, or Firm*—Jean C. Edwards, Esq.; Akerman Sentefitt

(57) ABSTRACT

Provided is a diaphragm edge of a speaker which is formed by compressing a material including silicon rubber and has an emboss portion on a front surface thereof so that sensitivity of sound is improved. Also, a diaphragm edge of a speaker is formed by compressing a material including silicon rubber and powdered viscose rayon and has an emboss on a front surface thereof.

9 Claims, 6 Drawing Sheets

DIAPHRAGM EDGE OF SPEAKER

BACKGROUND OF THE INVENTION

This application claims priority from Korean Patent Application No. 2003-14568, filed Mar. 8, 2003, the entire contents of which are herein incorporated by reference to the extent allowed by law.

1. Field of the Invention

The present invention relates to a diaphragm edge of a speaker, and more particularly, to a diaghragm edge of a speaker formed by compressing a material including silicon rubber and having an emboss portion on a front surface thereof so that sensitivity of sound is improved.

2. Description of the Related Art

A diaphragm edge of a speaker has largely two functions. One function is to smoothly respond to the movements of parts of a vibration system and a driving system and simultaneously accurately maintain the position of a diaphragm by preventing the diaphragm from moving in a lateral direction. The other function is to prevent a sound wave radiated from the diaphragm to the front side thereof and a sound wave having a reverse phase which is radiated to the rear side thereof from being mixed and offset.

The amplitude of the diaphragm is in inverse proportional to the square of a frequency. Thus, since a great amplitude appears in a lower sound range, the edge requires a mechanical linearity feature of a vibration direction. Also, the edge requires a high vibration absorption ability (an inner loss) to prevent sound generated from the edge due to resonance from exerting a bad influence upon performance of a speaker. Since the edge is coupled to the outer circumference of the diaphragm, a light one (a low density) like the diaphragm is required. To satisfy the required performance, various materials for the edge have been developed.

The types and features of materials for the edge which are generally used are shown below in Table 1.

TABLE 1

| Name | Material | Feature | |
|---|---|---|---|
| Coating fabric | Cotton woven fabric | Durability | Very good |
| | Polyester woven fabric + rubber | Mechanical linearity feature | Bad |
| | Polyurethane resin acryl resin | Price | Very bad |
| Foamed polyurethane rubber | Polyether base | Durability | Bad |
| | Polyester base | Mechanical linearity feature | Very good |
| | | Price | Mediocre |
| Elastomer | Styrene, Butadiene Rubber thermoplastic elastomer (polyurethane, polyester base) | Durability | Very good |
| | | Mechanical linearity feature | Mediocre |
| | | Price | Mediocre |

Among the materials for the edge listed in Table 1, a coating fabric and foamed polyurethane rubber are most used. Although the foamed polyurethane rubber is slightly expensive than the coating fabric, it is relatively cheaper and exhibits a balanced performance so as to be widely used. In the present specification, the foamed polyurethane rubber is mainly introduced.

A foamed polyurethane rubber edge has a low density and a superior elasticity which are features of a foamed material. Since the thickness of the foamed polyurethane rubber edge can be increased assuming it has the same weight compared to other materials, the foamed polyurethane rubber edge has an appropriate strength and a great support ability. Furthermore, the foamed polyurethane rubber edge is flexible so that the inner loss is great.

The foamed polyurethane rubber is generally classified into two types, i.e., polyester base and a polyether base, according to the type of polyol which is a material thereof, which are different characteristics. Polyester based polyurethane rubber has a superior weatherability but has a inferior moisture resistance so that, when the polyester based polyurethane rubber meets moisture and heat, it is hydrolyzed. In contrast, polyether based polyurethane rubber has a superior moisture resistance but has an inferior weatherability so as to be deteriorated by an ultraviolet ray.

Other than the foamed polyurethane rubber, the conventional materials for a diaphragm edge have defects as shown in Table 1. To improve the defects, a diaphragm edge including silicon receives wide attention.

Silicon itself exhibits high heat resistance, high cold resistance, high chemical resistance, high oil resistance, and high water resistance so that it is widely recommended as a material for the diaphragm edge. For example, in terms of the heat resistance, since the silicon has a great combination energy, it can be continuously used at temperatures between 150° C.~350° C. and with mechanical, electrical, and chemical stability. In terms of the cold resistance, since the silicon has an amorphous structure, it can be used at temperatures between −60° C.~−110° C. Also, in terms of a non-toxic feature, since the silicon is a physically inactive material, it can be used in the environment where a possibility of a human contacting the same is high.

Thus, when a silicon diaphragm edge is manufactured by using silicon, the various advantageous features of silicon can be reflected in the diaphragm edge. The frequency characteristic of a speaker has the shape of a sort of a low frequency filter. FIG. 1A is a plot showing the frequency characteristic curve of sound output from a speaker using a foamed polyurethane rubber edge. FIG. 1B is a plot showing the frequency characteristic curve of sound output from a speaker using a sponge edge. FIG. 2 is a plot showing the frequency characteristic curve of sound output from a speaker using a silicon edge. In the frequency characteristic curve of the conventional speaker, as indicated by portions A and B of FIGS. 1A and 1B, the amplitude is suddenly decreased in a predetermined frequency range. Such amplitude reduction phenomenon is also shown in the case of using the silicon diaphragm edge exhibiting a superior performance as a diaphragm edge as shown in a portion C of FIG. 2.

In the frequency characteristic curve of a speaker, the phenomenon in which the amplitude is suddenly decreased and returned to the original amplitude makes one, who listens to sound from a speaker that is a sound source, feel sound unsmooth.

Thus, a method is needed, which can maintain the diaphragm edge's durability, heat resistance, cool resistance, and so on, even when the environment where a silicon material is used changes, and prevent sound quality from being deteriorated by a sudden change in the amplitude in the frequency characteristic curve.

Also, a material having a low density and flexibility is used for the diaphragm edge of a speaker to improve sensitivity of sound. When the speaker is used for a long time, the shape of the diaphragm edge may be deformed by the weight of parts, in particular, the diaphragm, of the speaker. When the shape of the diaphragm edge is deformed so as not to be returned to the original shape, the sensitivity of sound is deteriorated.

SUMMARY OF THE INVENTION

To solve the above and/or other problems, the present invention provides a diaphragm edge of a speaker showing a frequency characteristic of sound output from the speaker which has an almost flat amplitude at its maximum in an effective frequency range. The speaker having such a frequency characteristic can output sound providing a high sound sensitivity and smooth sound sense.

Also, the present invention provides a diaphragm edge of a speaker, of which shape is prevented from being deformed by pressure or weight by constituent parts of the speaker. The diaphragm edge can maintain the original sound sensitivity for a long time, compared to the conventional technology.

According to an aspect of the present invention, a diaphragm edge of a speaker is formed by compressing a material including silicon rubber and has an emboss on a front surface thereof.

A diaphragm edge of a speaker is formed by compressing a material including silicon rubber and powdered viscose rayon and has an emboss on a front surface thereof.

The viscose rayon is powdered to have a length between 0.1mm-3.0 mm. The weight ratio between the silicon rubber and the viscose rayon is 100:3.

The diaphragm edge comprises a first adhesion portion disposed at an inner circumference thereof, a second adhesion portion disposed at an outer circumference thereof, and a roll disposed between the first and second adhesion portions, and the roll is one of an up-roll, a down-roll, an N-roll, an M-roll and a W-roll, and a line is formed on a lower surface of the roll to be convex and parallel to the inner or outer circumference.

BRIEF DESCRIPTION OF THE DRAWINGS

The above and other features and advantages of the present invention will become more apparent by describing in detail preferred embodiments thereof with reference to the attached drawings in which.

DETAILED DESCRIPTION OF THE INVENTION

Figure 3A:
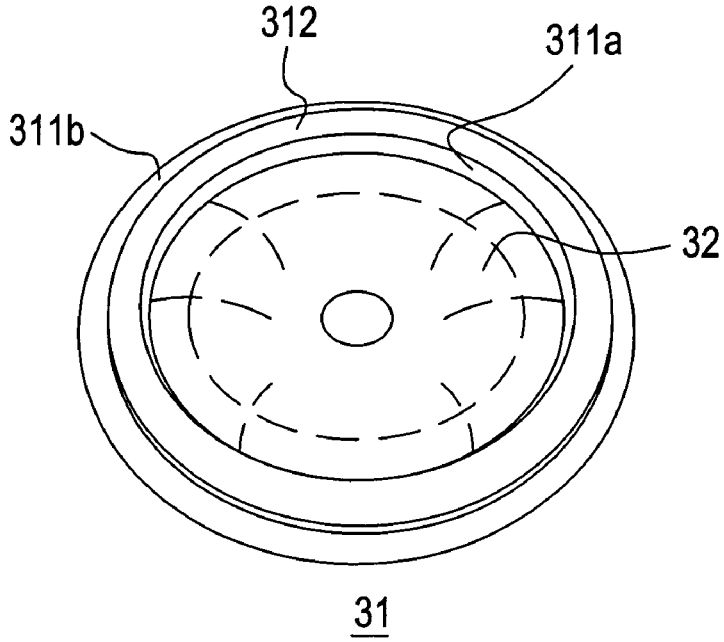
FIG. 3A is a perspective view illustrating a diaphragm to which a diaphragm edge according to a preferred embodiment of the present invention is attached.
Figure 3B:
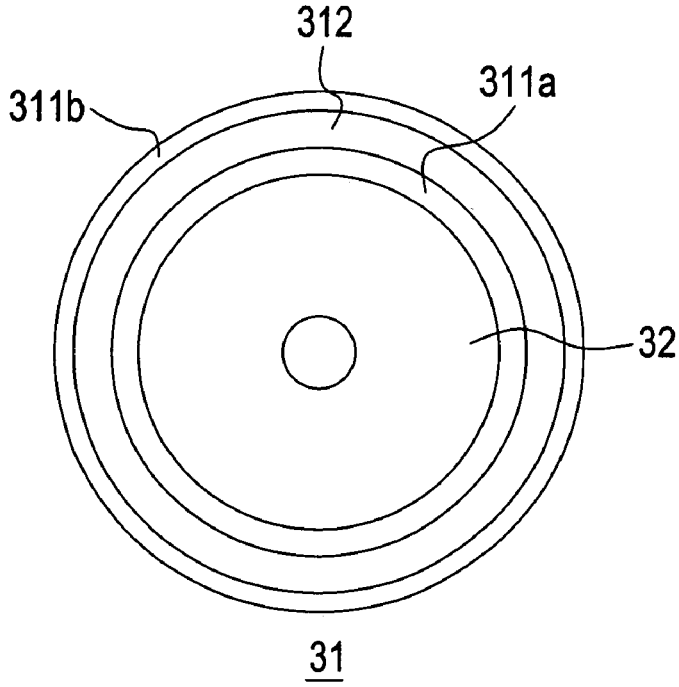
FIG. 3B is a plan view of the diaphragm of FIG. 3A.
Figure 3C:
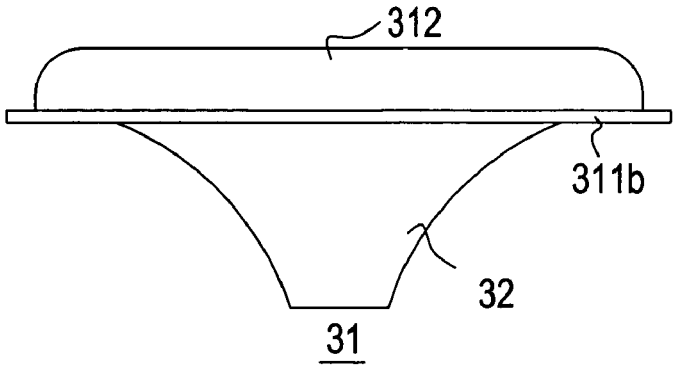
FIG. 3C is a side view of the diaphragm of FIG. 3A.
Figure 4A:
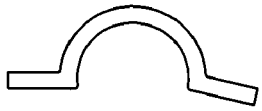
FIG. 4A-4E is a view illustrating various sections of a diaphragm edge which has an up-roll shape, a down-roll shape, an N-roll shape, an M-roll shape, and a W-roll shape.
Figure 4B:
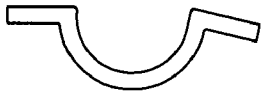
Figure 4C:
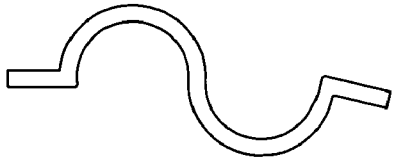
Figure 4D:
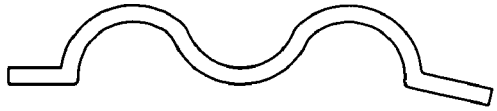
Figure 4E:
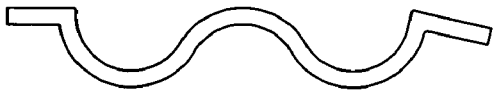

FIGS. 3A, 3B, and 3C are a perspective view, a plan view, and a side view, respectively, of a diaphragm having a diaphragm edge according to a first preferred embodiment of the present invention attached thereto. In FIGS. 3A through 3C, reference numerals 31 and 32 denote a diaphragm edge and a diaphragm, respectively. The diaphragm edge 31 consists of a first adhesion portion 311*a*, a second adhesion portion 311*b*, and a roll 312. Although the diaphragm edge 31 of a speaker shown in FIGS. 3A through 3C has an up-roll shape, this is a mere example and various shapes such as a down-roll shape, an N-roll shape, an M-roll shape, and a W-roll can be used in addition to the up-roll shape. FIG. 4 shows the sections of the diaphragm edge when the roll of the diaphragm edge is the up-roll (a), the down-roll (b), the N-roll (c), the M-roll (d), and the W-roll (e).

The diaphragm edge 31 according to the preferred embodiment of the present invention is formed by compressing a material including silicon rubber and an emboss is formed on a front surface thereof. By using a material including silicon rubber, the diaphragm edge 31 can have the heat resistance, cool resistance, non-toxic feature, chemical resistance, and weatherability which are merits of the silicon rubber. Thus, in whatever environments, the speaker can easily maintain the original quality of sound.

Preferred features that the diaphragm edge employs are described as follows.

The diaphragm generates a wave of condensation and rarefaction by pushing air around the diaphragm which becomes a sound wave. The quality of sound changes greatly according to the vibration type of the diaphragm. A performance needed from a speaker is to reproduce an input electric signal into sufficient sound. It is preferable that a speaker can reproduce sound in a wider frequency range from low-pitched sound to high sound and at a constant sound pressure (a degree of flatness in the amplitude in the frequency characteristic curve). In view of the frequency characteristic curve, it is preferable that a scope from the minimum resonance frequency (a lower limit of a low-pitched sound reproduction frequency) to the high-pass resonance frequency (an actual upper limit of a high-pitched sound reproduction frequency) is wide and the amplitude is large and the shape of the amplitude curve is flat and has less uneven portions.

To realized the above features, the diaphragm is required to have the following characteristics.

First, an elasticity/p must be high. Since a high-pass resonance frequency is proportional to the speed of sound and the speed of sound is determined by a square root of the elasticity/p, if the minimum resonance frequency is constant, a frequency range can be extended as the elasticity/p increases.

Second, an inner loss (impedance) must be large. The unevenness in the amplitude of the frequency characteristic curve is result from many resonances generated from the vibration system being sharp. If the inner loss is large, the peak of resonance can be flat.

Third, the diaphragm must be light. To obtain a larger sound pressure (amplitude) from an input signal having a particular energy, the vibration system including the diaphragm is preferably light.

That is, a material which has large elasticity/p and inner loss and is light is ideal for the diaphragm. These requisites for the diaphragm can be similarly applied to the diaphragm edge since the diaphragm edge is connected to the diaphragm. However, to realize a speaker which satisfies all three requisites which are in the contradictory relationship with one another, a method different from the conventional method is needed.

The diaphragm edge 31 according to the present preferred embodiment of the present invention can satisfy the above-described three requisites. The first and third conditions can be med met by using a material including silicon rubber for the diaphragm edge 31. The second condition can be solved by forming an emboss on the front surface of the diaphragm edge 31, if the diaphragm 32 vibrates back and forth (here, although the second adhesion portion 311*b* of the diaphragm edge 31 is fixed to a frame of the speaker case, since the first adhesion portion 311*a* of the diaphragm edge 31 is connected to the diaphragm 32, the diaphragm edge 31 is vibrated by the vibration of the diaphragm 32), since air resistance is decreased by the emboss so that the inner loss increases, the amplitude curve in the frequency characteristic curve is made flat compared to the conventional technology.

Thus, as the inner loss increases in the diaphragm edge 31, sound becomes smoother. Even when the size of the diaphragm 32 is small, mid- and low-pitched sound can be output. When the sound output from the speaker is lower pitched, the diaphragm 32 needs to vibrate more amount of air. Assuming that the size of the diaphragm is the same, the diaphragm edge 31 having the embossed portion can vibrate more amount of air.

Figure 5A:
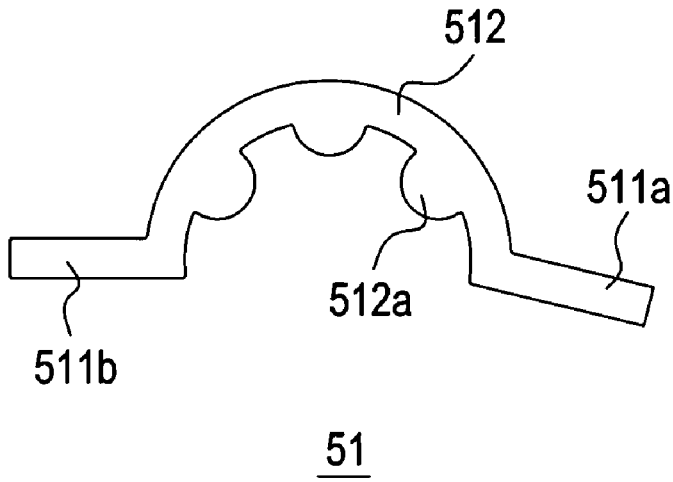
FIGS. 5A and 5B are a sectional view and a perspective view illustrating a diaphragm edge according to another preferred embodiment of the present invention.
Figure 5B:
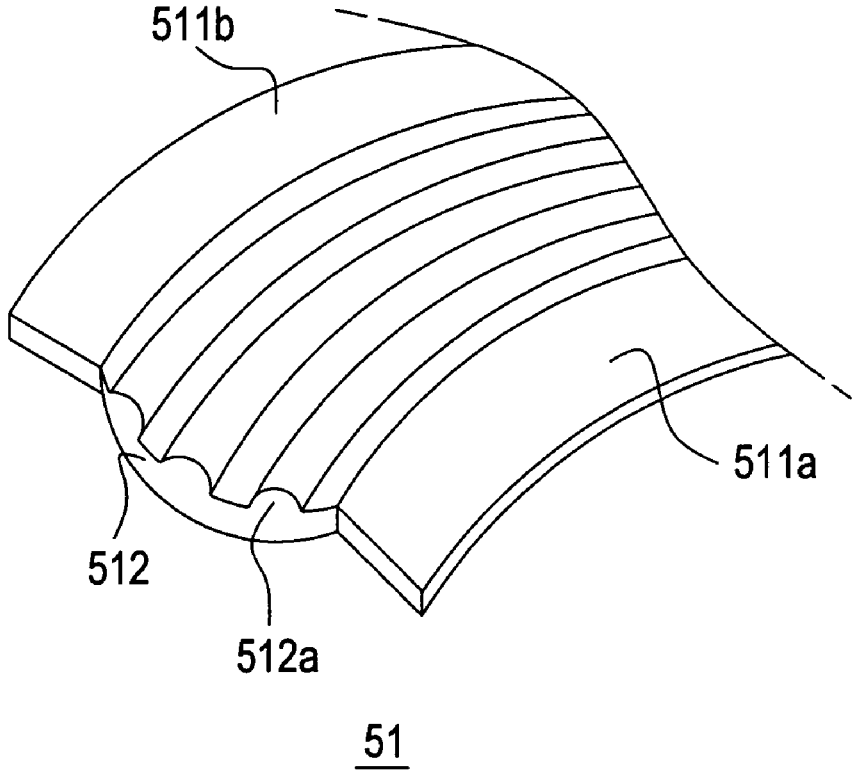

FIGS. 5A and 5B shows a diaphragm edge 51 according to a second preferred embodiment of the present invention. Referring to FIGS. 5A and 5B, the diaphragm edge 51 according to the second preferred embodiment of the present invention is characteristic in that a line 512*a* formed on a lower surface of a roll 512 to be convex and parallel to an inner or outer circumference, unlike the conventional diaphragm edge 31. Although the roll 512 has various shapes such as an up-roll and a down-roll, an arch portion is commonly included. Since the arch shape is weak at a force applied downward, the line 512*a* is formed to prevent deformation of the diaphragm edge 51. When the line 512*a* is formed on the lower surface of the roll 512 having the arch shape, durability to the downward force is enhanced. Thus, the shape of the diaphragm edge 51 cannot be easily changed in the hot summer season.

Although three lines are formed on the lower surface of the roll 512 in the drawings, the size and number of the line are not limited thereto and can be changed according to the size and purpose (for example, high-pitch or mid- and low-pitch) of the diaphragm. However, the width of the line 512*a* is preferably between 0.2 mm through 1.4 mm and the maximum height of the line 512*a* from the lower surface is preferably between 0.2 mm through 1.3 mm.

Since the diaphragm edge 51 has the same structure as that of the diaphragm edge 31, except that the line 512*a* is formed and the size of the emboss is different, a description thereof will be omitted herein.

A diaphragm edge according to the third preferred embodiment of the present invention will now described.

Since the diaphragm edge according to the third preferred embodiment of the present invention uses a different material and has the same basic structure, compared to the diaphragm edge 31 according to the first preferred embodiment, it will be described with reference to FIGS. 3A and 3C.

The diaphragm edge according to the third preferred embodiment of the present invention is formed by compressing and forming a material including a mixture of silicon rubber and powdered viscose rayon. The viscose rayon is a sort of textile and preferably used by being powdered to have a length of 0.1 mm through 3.0 mm. Also, the weight ratio of the silicon rubber and the viscose rayon is preferably 100:3. The diaphragm edge including the viscose rayon is lighter and has a less air resistance than the other diaphragm edge having the same size.

Also, the diaphragm edge according to the present preferred embodiment is the same as the diaphragm edge 31 in that an emboss is formed on the front surface thereof.

Figure 1A:
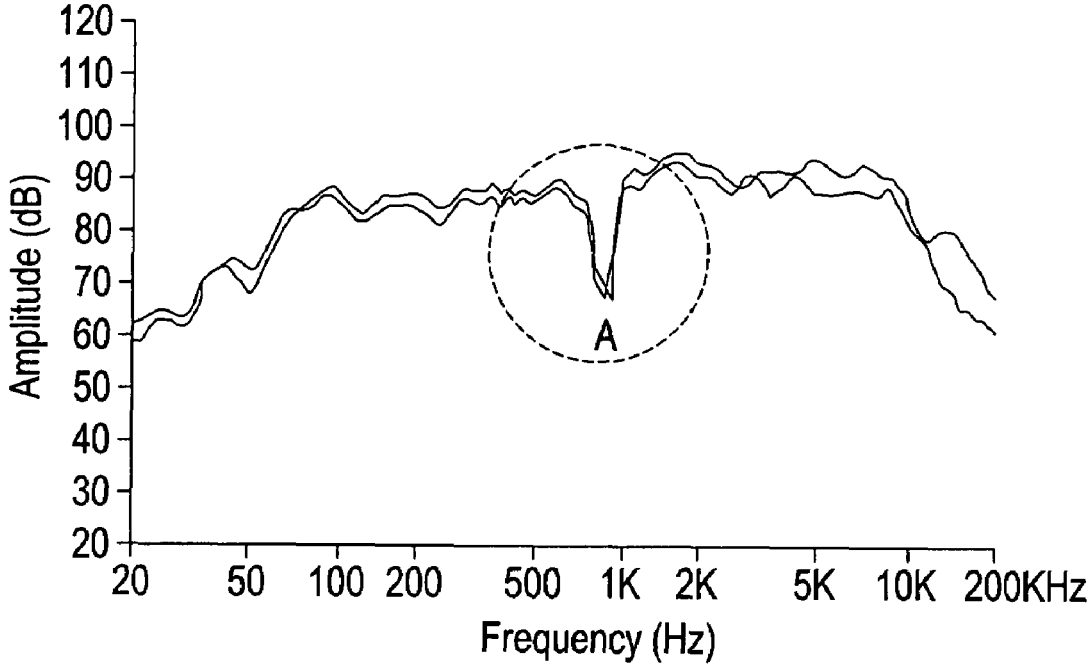
FIG. 1A is a plot showing the frequency characteristic curve of sound output from a speaker using a foamed polyurethane rubber edge.
Figure 1B:
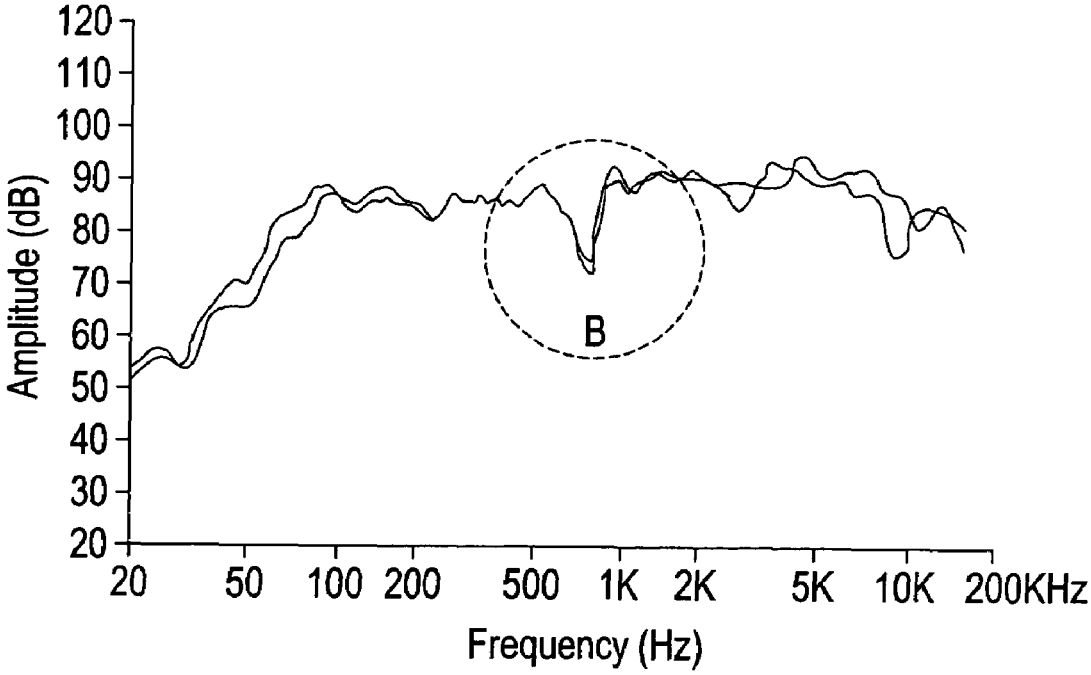
FIG. 1B is a plot showing the frequency characteristic curve of sound output from a speaker using a sponge edge.
Figure 2:
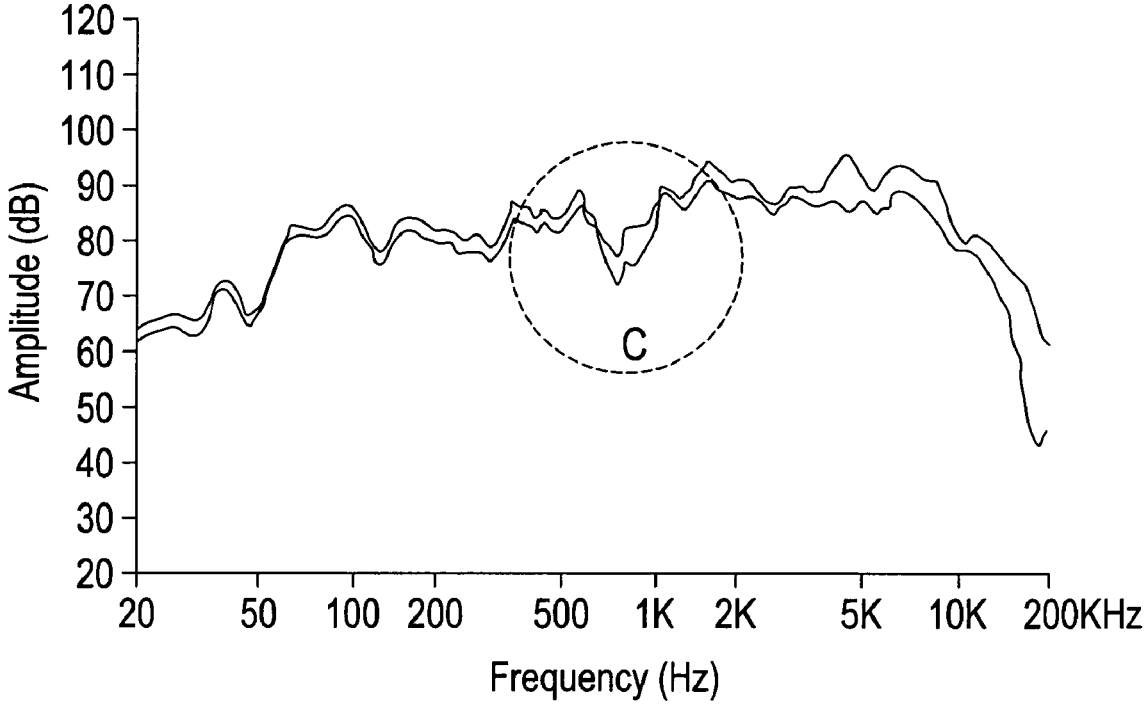
FIG. 2 is a plot showing the frequency characteristic curve of sound output from a speaker using a silicon edge.
Figure 6:
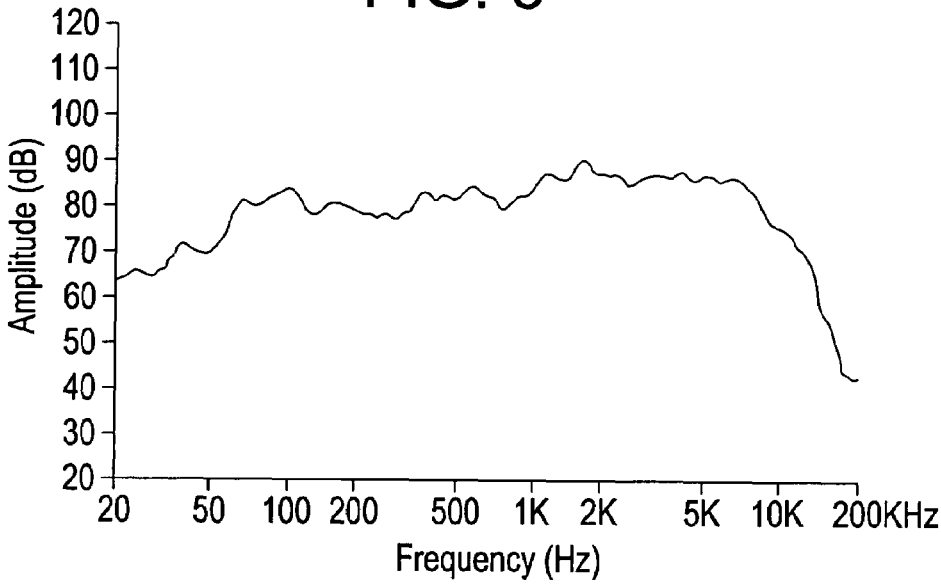
FIG. 6 is a plot showing the frequency characteristic curve using the diaphragm edge according to another preferred embodiment of the present invention.

FIG. 6 shows a frequency characteristic curve in a case of using the diaphragm edge according to the third preferred embodiment. Compared to the cases shown in FIGS. 1A, 1B, and 2, in the diaphragm edge according to the third preferred embodiment of the present invention using silicon rubber and viscose rayon as a material and simultaneously having an emboss formed on the front surface thereof, the amplitude curve is flat. Thus, the sound quality of a speaker is smooth and the sensitivity of sound is enhanced.

A diaphragm edge according to a fourth preferred embodiment of the present invention is described as follows. The diaphragm edge according to the fourth preferred embodiment of the present invention characteristically has a line formed convex on a lower surface of a roll and parallel to an inner or outer circumference (refer to FIGS. 5A and 5B). The reason for forming the line on the lower surface of the roll is the same as that in the diaphragm edge 51 according to the second preferred embodiment.

In the diaphragm edge according to the present preferred embodiment of the present invention, the width of the line is preferably between 0.2 mm through 1.4 mm and the maximum height of the line from the lower surface is preferably between 0.2 mm through 1.3 mm.

Figure 7:
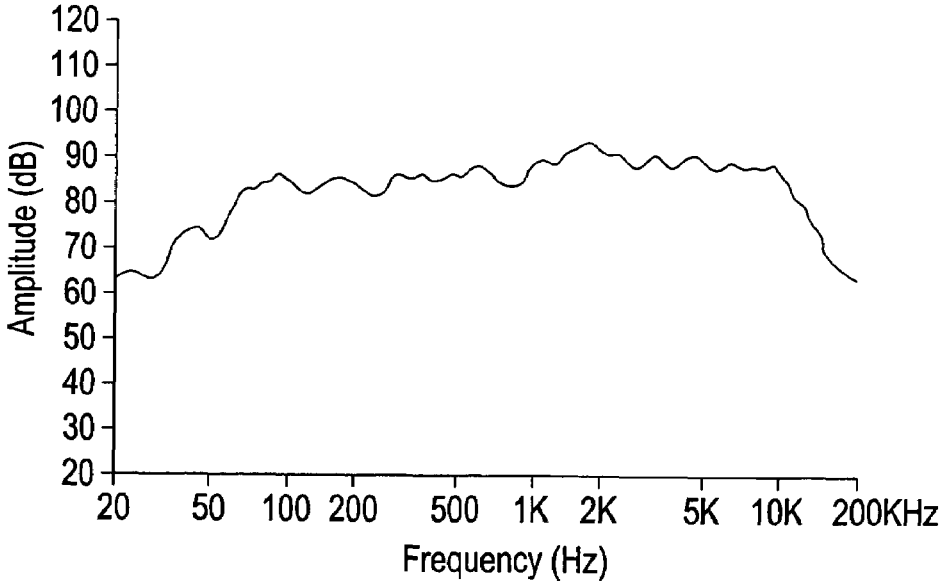
FIG. 7 is a plot showing the frequency characteristic curve using the diaphragm edge according to another preferred embodiment of the present invention.

FIG. 7 shows a frequency characteristic curve of a speaker using a diaphragm edge meeting the above figures. Here, it can be seen that, like the frequency characteristic curve of the diaphragm edge according to the third preferred embodiment of the present invention shown in FIG. 6, not only the amplitude curve is flat compared to the conventional technology but also the amplitude is increased when the line is formed, compared to the diaphragm edge according to the third preferred embodiment.

Since the diaphragm edge according to the present preferred embodiment has the same structure as that of the diaphragm edge according to the third preferred embodiment, except that the line is formed and the size of the emboss is different, a description thereof will be omitted herein.

Figure 8:
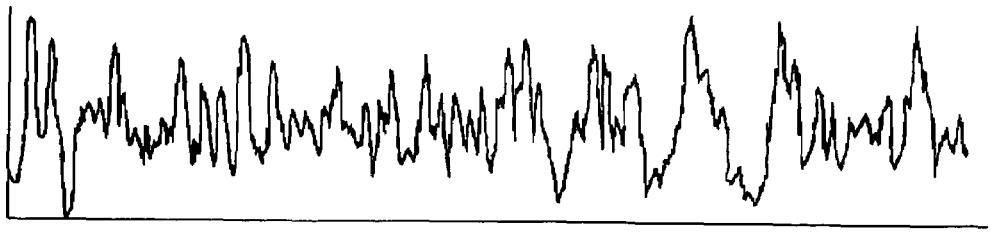
FIG. 8 is a view showing the front surface of the diaphragm edge along one sectional surface by magnifying the emboss in the diaphragm edge having the emboss formed therein according to the preferred embodiment of the present invention.

In the diaphragm edge according to the present invention, the emboss has an arithmetical mean deviation from the mean line of the profile (Ra) between 2.44 μm-28.70 μm, a maximum height (Ry) between 14.25 μm-120.00 μm, and a ten point average roughness (Rz) between 7.90 μm-97.00 μm. For example, FIG. 8 is a magnified sectional view of the entire front surface of the diaphragm edge 31 where the emboss is formed, wherein the emboss has an arithmetical mean deviation from the mean line of the profile (Ra) of about 6.60 μm, a maximum height (Ry) of about 37.00 μm, and a ten point average roughness (Rz) of about 23.70 μm. In FIG. 8, a unit of a solid line scale on a horizontal axis denotes 227.27 μm while a unit of a solid line scale on a vertical axis denotes 11.24 μm.

The arithmetical mean deviation from the mean line of the profile (Ra), the maximum height (Ry), and the ten point average roughness (Rz) are methods to indicate a texture (a degree of formation of an emboss) of a surface. When a function expressing a section curve showing a section of the diaphragm edge 31 is f(x), the arithmetical mean deviation from the mean line of the profile (Ra) is obtained from an equation that $Ra=\int|f(x)|dx$. The maximum height (Ry) corresponds to the length between the highest peak and the deepest trough on the section curve.

The above numeric limitation is based on the result of observation of a change of the frequency characteristic curve of the diaphragm while changing the size of the emboss.

While this invention has been particularly shown and described with reference to preferred embodiments thereof, it will be understood by those skilled in the art that various changes in form and details may be made therein without departing from the spirit and scope of the invention as defined by the appended claims.

As described above, according to the diaphragm edge according to the present invention, a speaker can provide smooth sound and superior sensitivity of sound. Also, the diaphragm edge can be prevented from being deformed by the weight of the diaphragm.

What is claimed is:

1. A diaphragm edge of a speaker, comprising:

a material formed by compressing components, including silicon rubber;

an emboss formed from the material and positioned on a front surface of the diaphragm edge;

a first adhesion portion disposed at an inner circumference of the diaphragm edge;

a second adhesion portion disposed at an outer circumference of the diaphragm edge;

a roll disposed between the first and second adhesion portions; and a raised portion provided on a lower surface of the roll to be convex in shape, the raised portion forming a line that is positioned in a direction parallel to the inner or outer circumference of the diaphragm edge, wherein the roll is one of an up-roll, a down-roll, an N-roll, an M-roll and a W-roll.

2. The diaphragm edge of claim 1, wherein a width of the raised portion is between 0.2 mm-1.4 mm and the maximum height of the raised portion from the lower surface is 0.2 mm-1.3 mm.

3. A diaphragm edge of a speaker, comprising:

a material formed by compressing components, including silicon rubber;

an emboss formed from the material and positioned on a front surface of the diaphragm edge, the emboss including:

an arithmetical mean deviation from a mean line of a profile (Ra) between 2.44 μm-28.70 μm, a maximum height (Ry) between 14.25 μm-120.00 μm, and a ten point average roughness (Rz) between 7.90 μm-97.00 μm.

4. A diaphragm edge of a speaker, comprising:

a material formed by compressing components, including silicon rubber and powdered viscose rayon;

an emboss formed from the material and positioned on a front surface of the diaphragm edge, the emboss having:

an arithmetical mean deviation from a mean line of a profile (Ra) between 2.44 μm-28.70 μm, a maximum height (Ry) between 14.25 μm-120.00 μm, and a ten point average roughness (Rz) between 7.90 μm-97.00 μm.

5. A diaphragm edge of a speaker, comprising:

a material formed by compressing components, including silicon rubber and powdered viscose rayon;

an emboss formed from the material and positioned on a front surface of the diaphragm edge, wherein the viscose rayon is powdered to have a length between 0.1 mm-3.0 mm, the emboss having:

an arithmetical mean deviation from a mean line of a profile (Ra) between 2.44 μm-28.70 μm, a maximum height (Ry) between 14.25 μm-120.00 μm, and a ten point average roughness (Rz) between 7.90 μm-97.00 μm.

6. A diaphragm edge of a speaker, comprising:

a material formed by compressing components, including silicon rubber and powdered viscose rayon;

an emboss formed of the material and positioned on a front surface of the diaphragm edge, wherein the weight ratio between the silicon rubber and the viscose rayon is 100:3, the emboss having:

an arithmetical mean deviation from a mean line of a profile (Ra) between 2.44 μm-28.70 μm, a maximum height (Ry) between 14.25 μm-120.00 μm, and a ten point average roughness (Rz) between 7.90 μm-97.00 μm.

7. A diaphragm edge of a speaker, comprising:

a material formed by compressing components, including silicon rubber and powdered viscose rayon; and an emboss formed from the material and positioned on a front surface of the diaphragm edge, wherein the diaphragm edge comprises:

a first adhesion portion disposed at an inner circumference of the diaphragm edge;

a second adhesion portion disposed at an outer circumference of the diaphragm edge;

a roll disposed between the first and second adhesion portions; and a raised portion provided on a lower surface of the roll to be convex in shape, the raised portion forming a line that is positioned in a direction parallel to the inner or outer circumference of the diaphragm edge, wherein the roll is one of an up-roll, a down-roll, an N-roll, an M-roll and a W-roll.

8. The diaphragm edge of claim 7, wherein a width of the raised portion is between 0.2 mm-1.4 mm and the maximum height of the raised portion from the lower surface is 0.2 mm-1.3 mm.

9. The diaphragm edge of claim 7, wherein the emboss has a an arithmetical mean deviation from a mean line of a profile (Ra) between 2.44 μm-28.70 μm, a maximum height (Ry) between 14.25 μm-120.00 μm, and a ten point average roughness (Rz) between 7.90 μm-97.00 μm.

* * * * *